United States Patent [19]

Bechmann

[11] Patent Number: 4,666,128

[45] Date of Patent: May 19, 1987

[54] SINGLE HEAD CAPSTAN WINCH

[76] Inventor: Peter Bechmann, Auweg 3, D-8114 Uffing, Fed. Rep. of Germany

[21] Appl. No.: 840,291

[22] Filed: Mar. 14, 1986

[30] Foreign Application Priority Data

Mar. 21, 1985 [DE] Fed. Rep. of Germany ..... 3510282

[51] Int. Cl.[4] ..... B66D 1/14; B66D 1/395; B66D 3/26

[52] U.S. Cl. ..... 254/329; 254/333; 254/346; 254/374

[58] Field of Search ..... 254/216, 219, 299, 329, 254/332, 333, 336, 346, 374, 383

[56] References Cited

U.S. PATENT DOCUMENTS

| | | | |
|---|---|---|---|
| 600,729 | 3/1898 | Lewis | 254/346 |
| 2,221,903 | 11/1940 | Abramson et al. | 254/346 X |
| 2,628,813 | 2/1953 | Arnold | 254/333 |
| 3,841,606 | 10/1974 | Declercq | 254/333 |
| 4,026,525 | 5/1977 | Declercq | 254/333 |
| 4,058,294 | 11/1977 | Dressler | 254/333 |
| 4,557,465 | 12/1985 | Lundberg | 254/333 X |
| 4,565,352 | 1/1986 | Hasselmann et al. | 254/219 X |
| 4,575,050 | 3/1986 | Bechmann | 254/374 X |

FOREIGN PATENT DOCUMENTS

| | | | |
|---|---|---|---|
| 872987 | 4/1953 | Fed. Rep. of Germany | 254/333 |
| 6602636 | 6/1969 | Fed. Rep. of Germany . | |
| 2517796 | 4/1976 | Fed. Rep. of Germany . | |
| 2939993 | 5/1980 | Fed. Rep. of Germany . | |
| 3138034 | 4/1983 | Fed. Rep. of Germany . | |
| 1035652 | 7/1966 | United Kingdom . | |

*Primary Examiner*—Stuart S. Levy
*Assistant Examiner*—Joseph J. Hail, III
*Attorney, Agent, or Firm*—Flynn, Thiel, Boutell & Tanis

[57] ABSTRACT

A single head capstan winch comprises a capstan head which is movably arranged on a supporting frame for being guided relative to a pressing roller and is also rotatably arranged on this supporting frame and provided with a dynamically balanced surface of a shape that complements the enveloping surface of a multiplicity of windings of a cable or rope of the winch to thereby obtain a load-controlled clamping force necessary for the hauling-in of a load by means of the forward extending portion of the cable or rope the rearward extension of which runs off free of any load from the capstan head.

9 Claims, 3 Drawing Figures

SINGLE HEAD CAPSTAN WINCH

FIELD OF THE INVENTION

This invention relates to a single head capstan winch having a capstan head which is adapted for being driven by a prime mover.

BACKGROUND ART

A single head capstan winch of the kind as herein referred is disclosed in German Offenlegungschrift No. 29 39 993. The capstan head of this known winch is provided with a drum having a relatively smooth surface for a frictional contact with multiple power-transmitting windings of a cable or rope whereby when the capstan head is being driven for hauling-in a load a forward portion of the cable or rope is continuously guided over a larger-sized diameter portion of its drum while a rearward portion of the cable or rope then free of any load runs off at the same time from a smaller-sized diameter portion of the drum. For obtaining the power-transmission with the multiple windings of the cable or rope there is further provided a clamping disk as arranged in parallel to the driving axis of the capstan head which clamping disk is arranged for being coupled to a driving shaft of the capstan head through ratchet means so that in the driven rotational direction of the capstan head a clamping groove is being formed between the axially biased clamping disk and the drum of the capstan head for continuously clamping the cable or rope at its rearward portion before the same free of any load runs off from the capstan head.

In British Pat. No. 1 035 652 a multiple head capstan winch is disclosed that comprises a capstan head which is adapted for being driven by a prime mover in the same manner as the capstan head of such single head capstan winches. Instead of a clamping disk arrangement this kind of multiple head capstan winches has further at least one deflection roller that is arranged in parallel to the capstan head for providing a load-transmitting frictional contact again of a multiplicity of windings of a cable or rope with the drum of the capstan head whereby the two ends of the cable or rope are at the same time fixedly anchored. There are further provided for this winch pressing rollers as also biased by springs which when the capstan head is being driven apply a pressing force each on a single winding of the cable or rope for its guiding on the drum of the capstan head and on the at least singular deflection roller. Such multiple head capstan winches usually allow a much higher power or load transmission in comparison with the single head capstan winches due to the fact that by means of their at least singular deflection roller an improved holding of the cable or rope on the capstan head is being obtained.

This invention accordingly deals with the object of providing a single head capstan winch of the general kind as above referred which without the need of a comparable clamping disk arrangement provides a load-controlled clamping force for the cable or rope to thereby obtain with a comparable driving power for the capstan head at the same time a factor of safety for the holding of a load that at least corresponds to the safety factor of multiple head capstan winches under comparable conditions.

SUMMARY OF THE INVENTION

A single head capstan winch according to the main feature of the present invention is provided with a supporting frame having a slide and guide track for holding and movably guiding the capstan head and its prime mover in an angular direction with respect to the hauling-in direction of a load. At least one pressing roller is rotatably arranged on this supporting frame with a rotational axis that extends under an angle with respect to the axis of the capstan head whereby this pressing roller is provided with a dynamically balanced surface of a shape that complements the enveloping surface of the multiple windings of the cable or rope so that with the pressing contact of this pressing roller with these multiple windings of the cable or rope a load-control clamping force is being provided.

The present invention accordingly provides a single head capstan winch which with this supporting frame for a movable arrangement of its capstan head and the rotational arrangement of such a pressing roller has a much improved load-transmission capacity in that thereby a clamping force through the cooperation with the pressing roller is obtained which is directly load-controlled and also influenced by the weight of the capstan head and its prime mover. The characterized shape of the surface of the pressing roller thereby assures at the same time that for all windings of the cable or rope an equal running speed is obtained at the gap between the capstan head and the pressing roller so that thereby any deformation of the cable or rope is positively avoided even under such conditions as typically experienced with such single head capstan winches as an axial shifting of the multiple windings of the cable or rope which may be caused by adhering substances which change the factor of friction of the cable or rope in respect to the power-transmitting surface of the capstan head. The inventive single head capstan winch accordingly allows the handling of much higher loads under comparable conditions whereby its load-controlled clamping force for the holding of the cable or rope on the relatively smooth surface of the drum guarantees at least the same factor of safety as the known multiple head capstan winches.

DESCRIPTION OF THE PREFERRED EMBODIMENT

Figure 1:
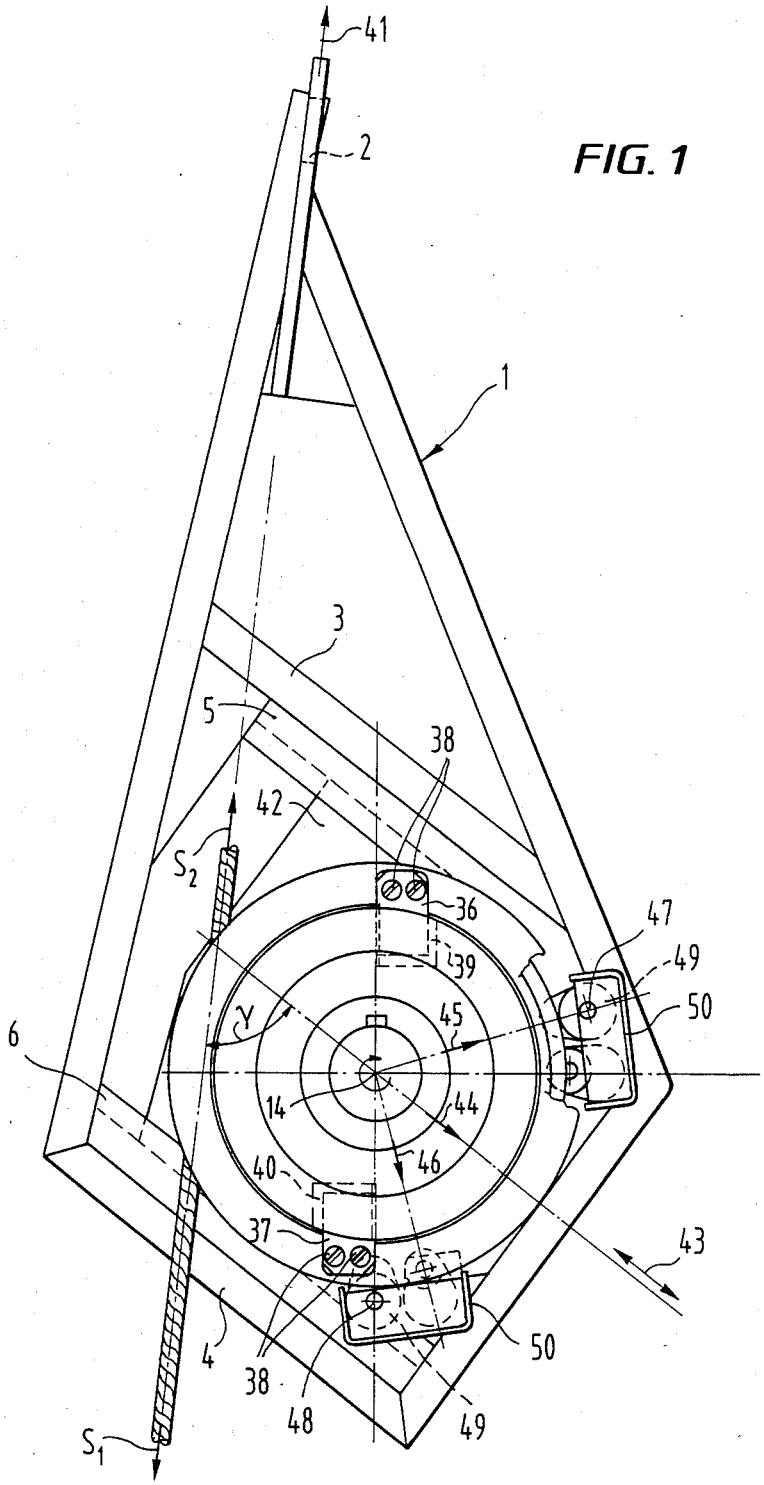
FIG. 1 is a front view of the inventive single head capstan winch in the direction of the arrow I in FIG. 2, partwise in section.

The single head capstan winch shown in the drawing incorporates a mobile embodiment which with the inclusion of a prime mover with a horse-power output of 4 HP (2.9 kW) and an ordinary planetary gearing has a total weight of only 16 kg (35 lbs). The winch comprises a supporting frame 1 which is welded together of individual brackets and which is provided with an eyelet 2 forming a means for allowing an anchorage of the frame. The frame 1 has two parallel brackets 3 and 4 which are each provided with a guide rail 5 and 6, respectively, forming a slide and guide track for holding and movably guiding the head 15 of the capstan winch.

Figures 2, 3:
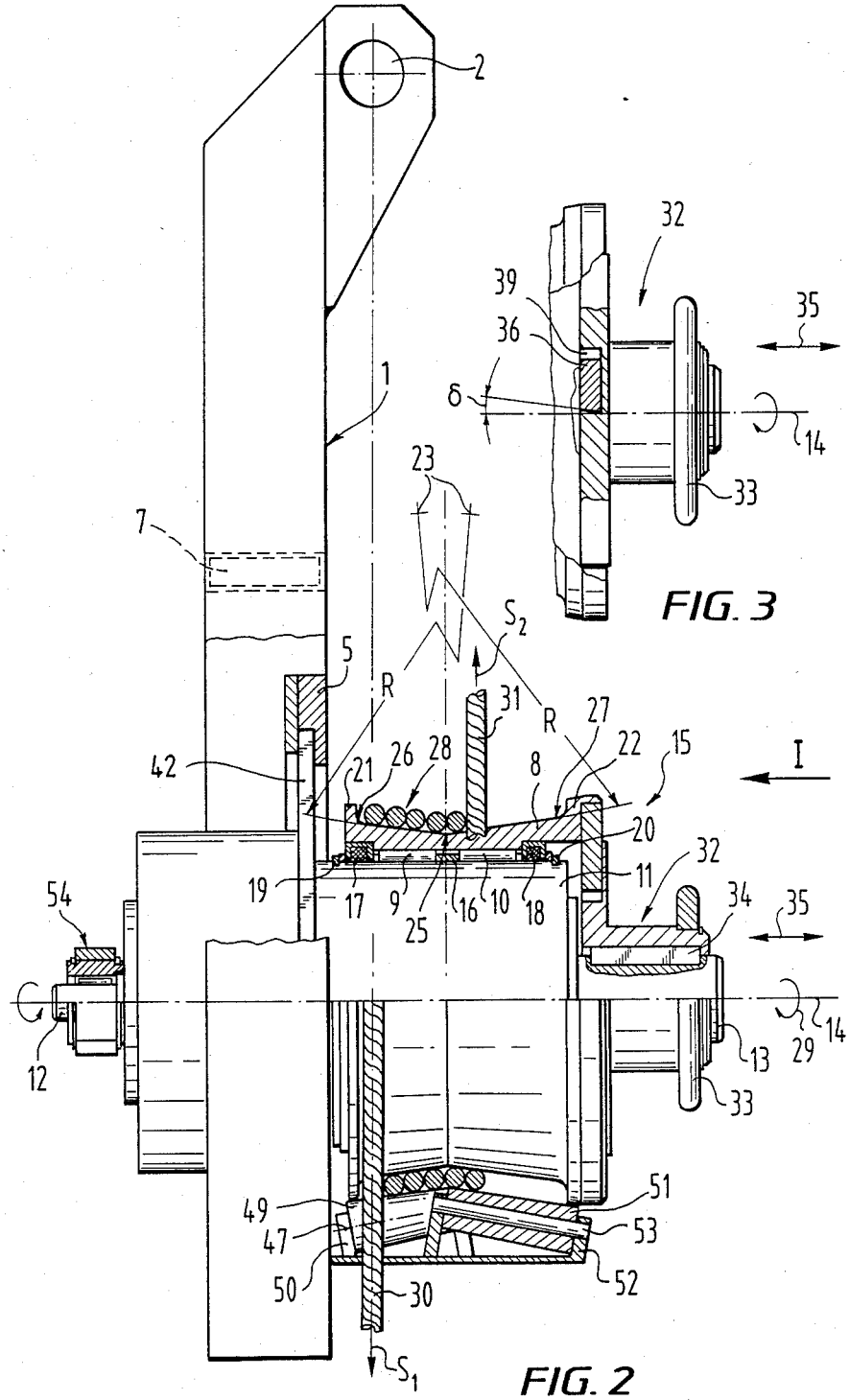
FIG. 2 is a side view also partwise in section of the capstan winch of FIG. 1.
FIG. 3 is a side view partwise in section of a claw clutch provided for the capstan winch of FIG. 1.

All main brackets of the frame 1 may comprise a rectangular hollow section 7 as shown in FIG. 2.

The capstan head 15 projects forwardly with respect to the broadside of the frame 1 and comprises a hollow drum 8 which by means of two needle bearings 9 and 10 is supported by a housing 11 of a planetary gearing which is of a normal design and therefore not shown in detail. The input and output shafts 12 and 13 of this gearing are arranged co-axial with the axis of the drum 8. The axial length of the drum 8 is chosen such that a plurality of for example six windings of a cable or rope may be wound around a partial length of the drum for power-transmitting purposes as will be explained. The two needle bearings 9,10 are spaced apart by means of a distance ring 16 and are arranged between two packing rings 17 and 18 that are inserted into two stepped centering bores of the drum 8. The drum 8 is held axially fast on the housing 11 by means of two locking rings 19 and 20 and has a dynamically balanced surface which between two ring-shaped flanges 21 and 22 provided at the axial ends of the drum corresponds more or less to the usual behavior curve of the capstan head of such capstan winches. This surface of the drum 8 accordingly is provided with a radius of curvature R having two centres and being much larger than the diameter of the drum which slightly outside of its axial centre has a smallest diameter portion 25 in comparison with the larger-sized diameter portions 26 and 27 of the drum adjacent its two end flanges The drum 8 is accordingly provided with two axial portions of for example such a different length that a multiplicity 28 of for example the beforementioned six windings of the cable or rope will more or less always maintain the position shown in FIG. 2 when the drum 8 is rotated in the sense of the arrow 29. With this direction of rotation of the drum 8 a forward portion 30 of the cable or rope is continuously guided over the larger-sized diameter portion 26 and continues with the six windings by the last of which a rearward portion 31 is continuously formed Any load hanged on the distant end of the forward portion 30 will accordingly be hauled-in with this rotational direction of the drum 8 whereby then the tractive force or pull $S_1$ existing in the forward portion 30 of the cable will be aligned with the force that anchors the frame 1 at its eyelet 2 as shown in FIG. 2 by the dot-dash line extending to the centre of the eyelet. The power or load transmission which then assures that the rearward portion 31 of the cable or rope continuously runs off from a smaller-sized diameter portion of the drum 8 then free of any load thereby fulfills the following known formula:

$$U=S_1-S_2$$

$$S_1=S_2 \cdot e^{\mu}\alpha$$

$$U=S_2\,(e^{\mu}\alpha-1)$$

wherein:

U=circumferencial force as transferred by the drum 8

$S_1,S_2$=tractive pulls of the forward and rearward portions 30 and 31 of the cable or rope $\alpha$=wrapping angle $\mu$=friction angle The multiplicity 28 of the cable or rope windings will on the other hand be shifted to the other larger-sized diameter portion 27 when the drum 8 is allowed to rotate around the axis 14 in a reverse direction In this reverse rotational direction the portion 31 of the cable or rope will then become its forward portion for obviously then also being continuously guided over the larger-sized diameter portion 27 while at the same time the other portion 30 runs off as a rearward portion of the cable or rope from a respectively smaller-sized diameter portion of the drum.

With a prime mover (not shown) coupled to the input shaft 12 of the planetary gearing the output shaft 13 of the same then forms an input shaft for driving the drum 8 by means of an interconnecting claw clutch 32. This claw clutch 32 comprises a driver member 33 which by means of a key 34 is connected rotatably fast but axially movable to the outpur shaft 13 as shown by the double arrow 35 in FIG. 2. This claw clutch 32 further comprises two claws 36 and 37 which are fixed to the face of the drum 8 by means of screws 38. The claws 36 and 37 which are spaced apart over an arc of 180° co-operate with two slightly larger dimensioned recesses 39 and 40 of the driver member 33 which are provided with friction surface complementing corresponding friction surfaces of the claws 36 and 37. These friction surfaces have an extension under an angle $\delta$ with respect to the rotational axis 14 which are mutually engaged when the driver member 33 is in its axially inward position whereas an axially outward shifting of the driver member will cause a disengagement of the friction surfaces of its recesses 39,40 in respect to the friction surfaces of the claws 36,37. With such a disengagement accordingly of the claw clutch 32 the drum 8 will be allowed to rotate freely on the housing 11 of the planetary gearing.

When the drum 8 of the capstan head 15 is being driven for hauling-in a load as explained before a reactive force in the direction of the arrow 41 will then be present as opposing the tractive force or pull $S_1$ that is created by the load which is hanged on the distant end of the forward portion 30 of the cable or rope. This reactive force extends parallel to the tractive force or pull $S_2$ of the rearward portion 31 of the cable or rope and at the same time under an angle to the direction in which the capstan head 15 is movably guided by means of an annular guide flange 42 along the slide and guide track provided by the guide rails 5 and 6 of the supporting frame 1. This movable arrangement of the capstan head 15 in the sense of the double arrow 43 provides with the weight of the capstan head and its prime mover an additional reactive force with first, second and third components 44,45 and 46 having their common centre in the rotational axis 14. The two components 45 and 46 of this additional reactive force are thereby directly influenced by the value of the angle $\gamma$ and are spaced apart over an arc of 90° as predetermined by a rotational arrangement of two additionally provided pressing rollers 49. These pressing rollers 49 having rotational axes 47 and 48, respectively, are supported by two U-shaped brackets 50 which are welded to the broadside of the frame 1. The force components 45 and 46 therefore extend to the rotational axes 47 and 48 of these two pressing rollers 49 for bringing about a pressing force acting on the first four windings on the left axial side of the drum 8. For avoiding any deformation of these windings and also for securing an identical running speed of all windings through the gap between these pressing rollers 50 and the drum 8 when the capstan head 15 is being driven these pressing rollers 50 are provided with a dynamically balanced surface of a shape that complements the enveloping surface of the multiplicity 28 of these windings. With this movable arrangement of the capstan head 15 on the supporting frame 1 a load-controlled clamping force accordingly will be created through the co-operation of the multiplicity 28 of the windings of the cable or rope with the pressing rollers 50 which load-controlled clamping force is far superior to the clamping force which in the so far known single head capstan winches is created as mentioned by means of any suitable clamping disk arrangement as biased by springs in respect to a clamping groove provided for the rearward portion of the cable or rope.

For obtaining this load-controlled clamping force also in the reverse rotational direction of the drum 8 there are similarily provided two further pressing rollers 51 also on the right axial portion of the drum. These further pressing rollers 51 are as well provided with a dynamically balanced surface of a shape that complements the enveloping surface of the multiplicity 28 of the windings of the cable or rope whereby their rotational axes 53 are again supported by two further U-shaped brackets 52 as welded also to the broadside of the frame 1. As shown in FIG. 2 for the pressing rollers 49 these pressing rollers 51 will accordingly act in the same manner when the drum 8 is allowed to rotate in a direction reverse to the arrow 29 whenever the claw clutch 32 is disengaged.

When the claw clutch 32 is disengaged the forward portion 30 of the cable or rope then may be drawn with its distant end to the location where remote from the anchorage position of the capstan winch a load is positioned which when hanged on this distant end shall be hauled-in. The rearward portion 31 of the cable or rope will then continuously be removed from any suitable cable storing means (not shown) that may be fixed to the supporting frame 1 in any suitable manner or that may find a separate arrangement for the storing of any arbitrary length of the cable or rope. When the load has been fixed to the distant end of the forward portion 30 and when subsequently thereto the claw clutch 32 then is being engaged, this load then will be hauled-in as soon as the drum 8 is being driven by the prime mover. With this driving of the drum 8 the interengaged friction surfaces of the claws 36,37 and the recesses 39, 40 then secure by their angle of inclination that the claw clutch 32 will not be disengaged during the rotation of the drum 8 which accordingly brings about an additional factor of safety for the operation of the capstan winch.

The input shaft 12 of the planetary gearing to which the prime mover is being coupled may be provided with a suitable braking means 54 for eventually braking the reverse rotation of the drum 8 at a stillstand of the prime mover and a then disengaged claw clutch 32. The reverse rotation of the drum 8 could alternatively be also controlled by using a reversible prime mover of the kind as used in ordinary lifting gears for elevators so that with this in mind the present capstan winch may be used for either a horizontal and/or a vertical moving of loads. Instead of incorporating a mobile embodiment this capstan winch may also be incorporated in a stationary embodiment without departing from the present invention.

While the invention has been shown and described in its preferred embodiment, it will be clear to those skilled in the art to which it pertains, that many changes and modifications may be made thereto without departing from the scope of the invention.

What is claimed is:

1. A single head capstan winch, comprising:

a capstan head which is adapted for being driven by a prime mover and provided with a drum having a relatively smooth surface for a frictional contact with a muliplicity of power-transmitting windings of a cable or rope whereby when the capstan head is being driven for hauling-in a load a forward portion of the cable or rope is continuously guided over a larger-sized diameter portion of its drum while a rearward portion free of any load then runs off at the same time from a smaller-sized diameter portion of the drum;

a supporting frame having a slide and guide track for holding and movably guiding the capstan head and its prime mover in an angular direction with respect to the hauling-in direction of a load; and at least one pressing roller that is rotatably arranged on said supporting frame with a rotational axis that extends under an angle with respect to the axis of the capstan head whereby this pressing roller is provided with a dynamically balanced surface of a shape that complements the enveloping surface of said multiplicity of windings for obtaining a load-controlled clamping contact of this pressing roller with all windings of the cable or rope when the capstan head is driven in a predetermined rotational direction.

2. A single head capstan winch according to claim 1 wherein said supporting frame is provided with at least two pressing rollers for alternately contacting said multiplicity of the windings of the cable or rope as axially shifted on said drum whenever its direction of rotation is changed between a forward and a reverse driving of the capstan head.

3. A single head capstan winch according to claim 1 wherein for each rotational direction of the capstan head two pressing rollers are provided as spaced apart over an arc of 90° .

4. A single head capstan winch according to claim 1 wherein said supporting frame comprises two parallel brackets having each a guide rail for holding and movable guiding the capstan head and its prime mover by means of an interconnected guide, flange whereby close to the position of these brackets further brackets are fixed to the frame for rotatably holding the pressing roller.

5. A single head capstan winch according to claim 1 wherein said supporting frame is provided with an eyelet as an abutment means for the load when being hauled-in.

6. A single head capstan winch according to claim 1 wherein a braking means is provided for eventually braking the capstan head.

7. A single head capstan winch according to claim 1 wherein said drum is being driven by an output shaft of a planetary gearing on a housing of which the drum is rotatably arranged for an engageable connection to said output shaft by means of a driving member of a claw clutch.

8. A single head capstan winch according to claim 7 wherein said claw clutch is formed with at least two claws on the drum of the capstan head and two complementary shaped recesses of the driving member which is connected to said output shaft of the planetary gearing as being rotatable therewith but at the same time relatively movable in its axial direction.

9. A single head capstan winch according to claim 8 wherein said claws and said recesses are provided with interengageable friction surfaces that extend in an angular direction with respect to the axis of the capstan head.

* * * * *